US005417430A

United States Patent [19]

Breeding

[11] Patent Number: 5,417,430

[45] **Date of Patent: * May 23, 1995**

[54] PROGRESSIVE WAGERING METHOD AND GAME

[75] Inventor: John G. Breeding, St. Louis Park, Minn.

[73] Assignee: Shuffle Master, Inc., Eden Prairie, Minn.

[ * ] Notice: The portion of the term of this patent subsequent to Feb. 22, 2011 has been disclaimed.

[21] Appl. No.: 43,413

[22] Filed: Apr. 6, 1993

Related U.S. Application Data

[63] Continuation-in-part of Ser. No. 23,196, Feb. 25, 1993, Pat. No. 5,288,081.

[51] Int. Cl.[6] ..... A63F 1/00

[52] U.S. Cl. ..... 273/292; 273/309; 273/274

[58] Field of Search ..... 273/292, 274, 309, 85 CP, 273/138 R, 139

[56] References Cited

U.S. PATENT DOCUMENTS 4,948,134 8/1990 Suttle et al. ..... 273/85 CP

OTHER PUBLICATIONS

Scarne's Encyclopedia of Games, John Scorne, Harper & Row Publishers, pp. 33–41, 1973.

Michigan Legionnaire, Wild Deuces Michigan Lottery, p. 15, Oct. 1978.

*Primary Examiner*—Benjamin H. Layno

*Attorney, Agent, or Firm*—Dorsey & Whitney

[57] ABSTRACT

A progressive jackpot wagering game and method, including a playing card wagering game, involves placing a game wager and an optional jackpot wager. Cards are dealt by the dealer, two face down to the dealer and three face down to each player. Players inspect or "sweat" their cards and the dealer asks "take it or leave it?" with regard to one part of the bet. Each player decides and the dealer then turns over one of the cards and again asks "take it or leave it?" with regard to the second part of the bet. The players decide, their cards are shown, and based on the shown cards the game wagers are resolved. Also based on the shown cards, players become eligible for a second wagering game for determining a winner of the progressive jackpot.

11 Claims, 2 Drawing Sheets

PROGRESSIVE WAGERING METHOD AND GAME

This application is a continuation-in-part of application Ser. No. 08/023,196, filed Feb. 25, 1993, now U.S. Pat. No. 5,288,081.

TECHNICAL FIELD

The present invention relates to progressive wagering games. In particular, it relates to a method and apparatus for playing a progressive jackpot wagering game, wherein the game may be played in conjunction with other wagering games, such as poker games.

BACKGROUND ART

There are many wagering games used for gambling. Such games should be exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al.). Somewhat similarly, U.S. Pat. No. 3,667,757 (to Holmberg) discloses a board game and apparatus, including a way to allow the player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

The desired attributes of wagering games outlined above are in large measure provided by the method and apparatus for a wagering game in accordance with the present invention. The game is uncomplicated, exciting and provides the opportunity for players to make multiple wagers, including a wager for a progressive jackpot, and choices regarding those wagers.

SUMMARY OF THE INVENTION

A progressive jackpot wagering method and game is provided. The progressive jackpot game and method involves placing a wager to participate in the jackpot game, playing a first wagering game to select a group of qualified players or finalists and playing a second wagering game to select a winner of the jackpot from the group of finalists. The second game occurs at a time measured by the occurrence of a selected event: when the progressive jackpot reaches a predetermined amount, after a predetermined time period or after a predetermined number of finalists is determined.

One wagering game for use with the progressive wagering method and game of the present invention is played with a single, typical fifty-two card poker deck and broadly involves the generally well recognized and accepted set of rules, procedures and wager-resolving relationships and rankings of poker. The game method comprises each player placing an initial, three-part game wager to participate in the game. Each player may place an optional wager, of a fixed amount, to participate in a progressive jackpot game.

After wagers are placed, cards are dealt by a dealer, three down to each player and two down to the dealer. Players inspect or "sweat" their cards, and the dealer asks "take it or leave it?" or "let it ride?" with regard to a first part of the initial bet. Players can choose to retrieve or remove from play the first part of their initial bet, or leave the first part in play or at risk, based on the value of the three cards in their hand. The dealer then turns over one of the dealer's cards and the dealer's query is repeated with regard to a second part of the initial bet. Players can choose to retrieve or remove from play the second part of their initial bet or leave the second part in play or at risk, based on the value of the four cards consisting of the three cards in the player's hand and the exposed dealer's card. Players have no option with the third part of the bet.

Finally, all cards are shown and the payouts and collections related to the game wager are resolved according to the ranking of the poker hand of each player, i.e., the players are not playing against each other or the dealer. If a player elected to participate in the progressive jackpot aspect of the game, the ranking of that player's hand determines the outcome of that player's wager and the portion, if any, of the progressive jackpot that player wins.

More specifically, the initial wager placed by each player comprises three equal parts and is made or placed before any cards are dealt. Each player is dealt three cards face down in the customary fashion. Two common cards are dealt face down in front of the dealer for use by all of the players. Each player will use the two common cards in front of the dealer in combination with his or her three cards to create a five card hand. After all players have placed their bets and received and examined their three cards, each is given the opportunity to retrieve one-third of the initial wager before the dealer reveals one of the two down cards previously placed in front of him.

After all of the players have been queried and decided whether to take or leave the first part of the initial game wager, the dealer turns one of the down cards face up. Each player now has the benefit of four cards, the three he or she is holding down plus the common card, and the dealer again gives each player the opportunity to retrieve one-third of the beginning wager before exposing the second common down card. After the second common down card is revealed, the players turn up the three cards they are holding thereby forming a five card hand made up of the three cards dealt to each player and the two dealer cards.

The dealer examines each of the players' hands and determines what payout, if any, each player is entitled to receive according to that player's remaining portion of the initial game wager and a preselected payout schedule. Payouts are made to players with winning hands and the losing wagers are collected. The cards are then reshuffled for the next hand.

With regard to the progressive jackpot game, players elect to participate by wagering a fixed side bet amount on the chance that their final five card hand will embody one of a number of predetermined designated poker hands. If a participating player's hand comprises one of the designated winning hands, that player wins a corresponding jackpot bonus payout amount, which is paid out immediately at the end of the hand. Further, if a participating player's hand comprises a selected one of the predetermined winning hands, that player becomes eligible to win a super jackpot formed by a three month accumulation of said wagered fixed amounts. The designated winning hands in the progressive game may correspond to traditional poker hands or card arrangements, but are not limited to any particular arrangements, and a casino may design and use any ranking, accumulation period, and payout scheme.

The present invention encompasses an apparatus for playing the wagering game according to the method outlined above. A typical gaming table, with a playing surface, is modified to include specific areas that provide locations and apparatus for placing the wagers, including the optional bet to participate in the progressive jackpot game, and for displaying the common cards. The apparatus may be adapted to include the progressive gaming apparatus disclosed in the U.S. patent application entitled "Progressive Gaming Apparatus", invented by Breeding and Helgesen and commonly owned, the former inventor being the inventor of the present invention.

A card shuffling machine such as that disclosed in U.S. Pat. No. 4,807,884 (also invented by the inventor of the present invention and commonly owned) for facilitating and speeding the play of the wagering game may be used. A display device may be associated with the apparatus for displaying game information, including information about the progressive jackpot aspect of the game.

It is an object of the present invention to provide a progressive jackpot wagering game and method which may be played or practiced in conjunction with other wagering games or as a stand alone wagering game wherein a prospective participant wagers a fixed amount to participate, wherein a random outcome determines a group of finalists from among the participants, and wherein a second random outcome determines a winner from among the group of finalists.

It is another object of the present invention to provide an exciting and interesting wagering game that is easy to learn, largely being based on poker and the well known ranking of poker hands.

It is another object of the present invention to provide a new variation of a well known wagering game, five card poker, which is made interesting by providing the opportunity for players to make multiple wagers and decisions related to those wagers based on the progress of the game, as well as the chance to win an immediate bonus payout and become eligible to win a large, accumulated progressive jackpot.

Still another object of the present invention is to provide a wagering game that is easy to learn, yet demands skill of players in making strategic decisions about whether to let part of their bet ride.

It is yet another object of the present invention to provide a unique, exciting card game for play in casinos or at home and on various media including casino tables, video poker machines, video lottery terminals or home computers.

It is an advantage of the game of the present invention that wagering decisions are inherent in the game. The game enhances players' sense of participation and takes advantage of players' inclination to let wagers ride once placed. Another advantage of the game is that the possibility of immediately winning a portion of a progressive jackpot, or becoming eligible to win a substantial accumulated jackpot amount, makes the game more exciting and, therefore, more interesting to players.

DETAILED DESCRIPTION OF THE PREFERRED EMBODIMENT

Figure 1:
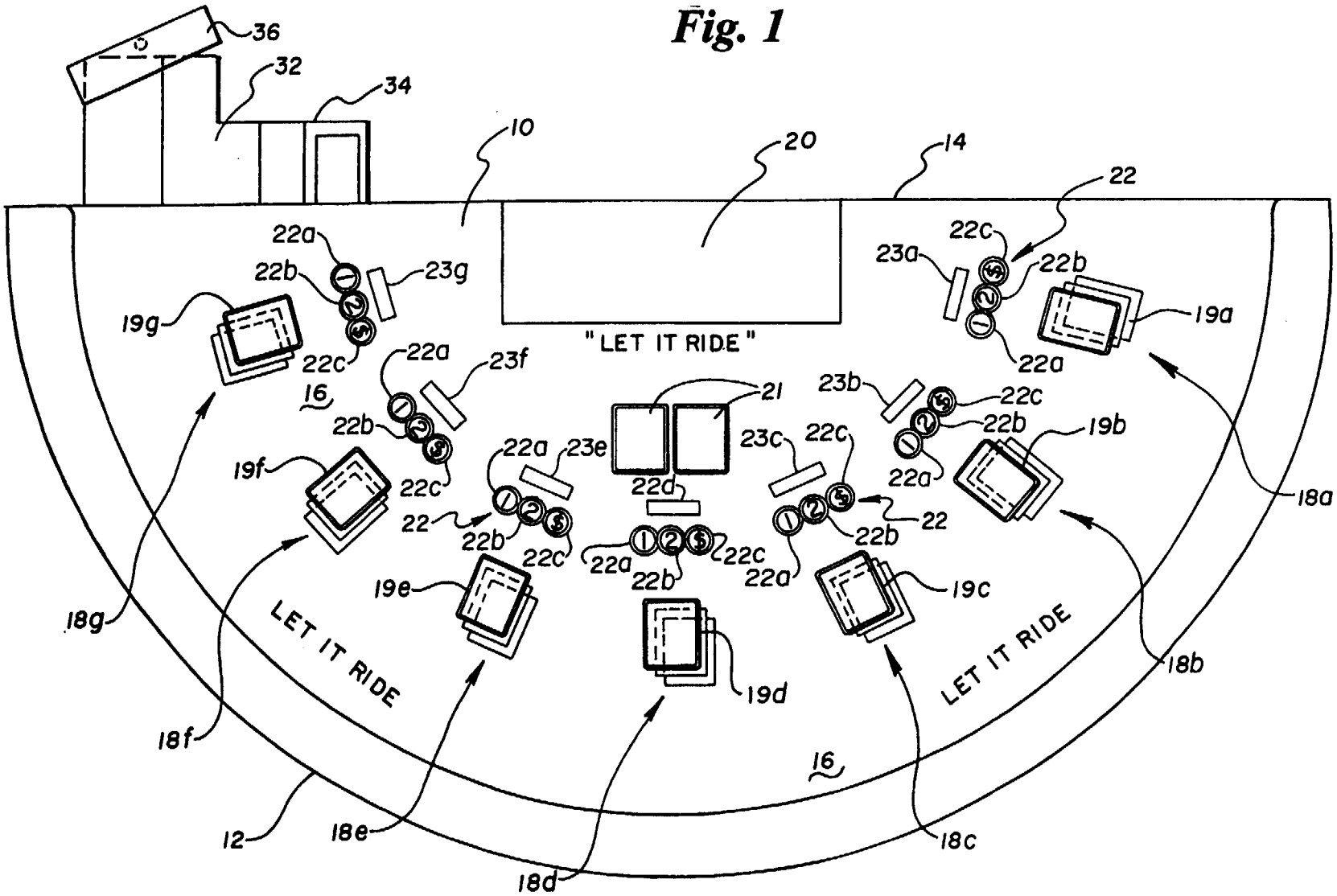
FIG. 1 depicts the table layout and apparatus used in playing the wagering game of the present invention.

Referring to FIG. 1, the apparatus for the wagering game of the present invention includes a typical casino gambling or gaming table 10. The table 10 has a curved side 12 for accommodating up to seven players and a straight side 14 for accommodating the dealer. The table 10 has a flat surface 16 covered with felt or other appropriate material. Although seven playing positions or locations 18*a–g* for individual players are provided, it is not essential to the game that exactly seven persons play and as many as sixteen players may participate. For casino play, a maximum of seven players provides for a game that is easily manageable by the dealer and house, and one in which the individual players feel more involved. A house dealer position 20, including an area suitable for displaying the dealer's common cards 21, is provided.

Each of the playing positions 18*a–g* includes a wagering zone 22, comprising three separate and distinct wagering or betting areas 22*a, b, c*. Each position 18*a–g* also includes a card area 19*a–g* for receiving and displaying cards dealt to the player occupying the position. A suitable wagering area or apparatus for receiving or indicating a wager in the progressive aspect of the game is represented at area 23*a–g*. The wagering areas 22*a, b, c* and 23*a–g* may be designed to receive appropriate wagering indicators or settling means such as chips (not shown).

At one side of the dealer station 20, the apparatus for practicing the method of the present invention may include a microprocessor or computer controlled shuffling machine 32 supported by a table extension 34. The shuffling machine 32 may be of the type disclosed in U.S. Pat. No. 4,807,884, the disclosure of which patent is incorporated herein by reference. The shuffling machine 32 may include a dealing module for automatically and sequentially dealing cards and also may include a display means for displaying wager amounts, the identity of winning players, or other game related information, including progressive jackpot information.

Figure 2:
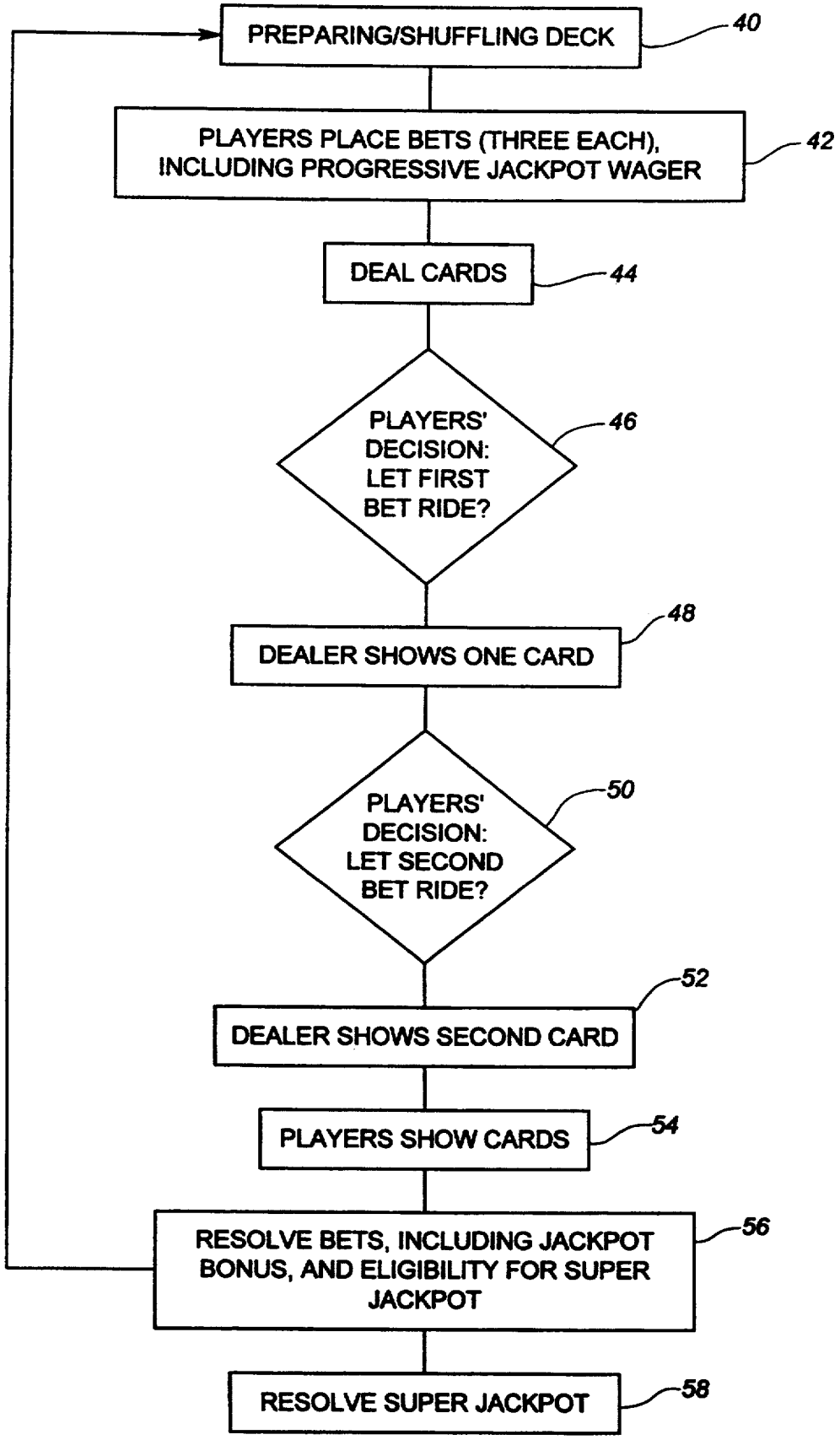
FIG. 2 is a block diagram representing the flow of play in the game.

Referring to the flow diagram of FIG. 2, the initial step in playing the game of the present invention is preparing or shuffling a deck of cards, represented at block 40, by activating the shuffling machine 32 or by hand-shuffling a deck to provide a shuffled deck. Next, the players place the initial wager, block 42, by putting equal amounts in each of the three betting areas 22*a, b, c*. Two of the parts of this initial wager, the parts placed in wagering area 22*a* and 22*b* are retrievable at the option of the player. The third portion placed in area 22*c* is a nonwithdrawable bet. After the placing of the wager by each player, the cards are dealt, block 44, three cards being dealt down to each player and two cards are dealt down in front of the dealer.

The players inspect or "sweat" their cards in preparation for reaching decision block 46. At decision block 46, the players are queried by the dealer about whether the first part of the initial wager, the part placed in wagering area 22*a*, should be left or whether the player wishes to withdraw that portion of the bet. Each player makes the decision at decision block 46 on the basis of the three cards forming the player's incomplete hand at this point. Once each player has been queried and has decided whether or not to let the first portion of the bet ride, and those bets the player chooses to retrieve or remove are physically removed from area 22*a* and returned to the player, the dealer shows one of the down common cards, block 48. Now, each player has four cards to consider, the three cards dealt to that player originally and the single common card showing on the table. Each player must then decide whether to let the second part of the initial wager ride or whether to withdraw it from the game. After each player is queried and decides what to do with regard to the second part of the bet, and those bets to be withdrawn are physically removed from area 22*b* and returned to the player, the dealer reveals the second common down card, as represented at block 52. Each player now has a five card hand comprised of the three cards each player was originally dealt plus the two revealed common cards. The third bet, the bet placed at wagering area 22*c*, is a nonretrievable portion of the initial bet and the flow of the game proceeds to block 54 wherein the players show or reveal their three cards to the dealer.

The dealer resolves each player's bet (which includes all three parts, the second and third part or only the third part, depending on the player's choices during play of the hand) based on the five card hand at block 56 and determines what payout, if any, the player is entitled to receive according to the payout schedule at the particular gaming table or casino. Bets on non-winning hands are collected by the dealer or house. The hand is then over and the flow of the game returns to block 40, preparing and shuffling the deck for a new hand.

The award or payoff is given for each part of the initial game bet that was allowed to ride to the end of the hand and for the nonwithdrawable part of the bet. A typical pay table would be as follows:

| | |
|---|---|
| Pair, Tens or Better | 1-1 (even money) |
| Two Pairs | 2-1 |
| Three of a Kind | 3-1 |
| Straight | 5-1 |
| Flush | 8-1 |
| Full House | 11-1 |
| Four of a Kind | 50-1 |
| Straight Flush | 200-1 |
| Royal Flush | 1,000-1 |

With regard to the progressive jackpot game and method of the present invention, along with placing their initial game wager, block 42, the players may place an optional side bet of a fixed, predetermined amount to become eligible to win a progressive jackpot. The game flow then proceeds as represented in blocks 44–56. At block 56, along with resolving players' remaining game bet, the dealer will at least partially resolve players' progressive jackpot side bet, if any. The progressive jackpot bets are at least partially resolved by the dealer immediately by paying out to participating players according to the following table:

| | |
|---|---|
| Flush | $30.00 |
| Full House | $125.00 |
| Four of a Kind | $400.00 |
| Straight Flush | $2,500.00 |
| Royal Flush | $20,000.00 |

Each player participating in the progressive wagering aspect and having a final hand comprising a royal flush becomes eligible to participate in a super jackpot game, represented at block 58. The basic wagering game and the super jackpot game may be a lottery type game, any suitable wagering game or any suitable random process through which eligible finalists are selected and through which one of the eligible finalists is identified as a jackpot winner. The basic game and the super jackpot game may be different games, and the super jackpot game may be played at a different place than the basic game. The progressive super prize or jackpot is comprised of jackpot side bets, or a portion thereof, accumulated for a selected period. The selected period must insure that a very substantial jackpot, for example, a million or multi-million dollar jackpot, accumulates. Ideally, the selected period is at least one month, but a typical period would be three months, particularly if the funding program or schedule set forth below is followed. Eligible finalists in the super progressive jackpot game, i.e., all the basic game players having a final hand comprising a royal flush, are accumulated during a period equal to the jackpot accumulation period. If no royal flush has been achieved during the selected accumulation period, the next highest winning hand is used to determine eligibility for the super jackpot game. The winner of the super jackpot game is awarded or collects 75% of the accumulated jackpot amount; any other finalists equally share the remaining 25% of the accumulated amount.

A typical funding program for the progressive jackpot side bet game and method of the present invention, particularly the payouts associated therewith, may be outlined as follows. A one dollar ($1.00) fixed side bet is required to participate in the progressive jackpot game. Of this side bet, forty cents (0.40) is used to fund immediate bonus payouts to players, the bonus payouts being based on a random outcome or certain poker rankings as set forth above. Forty-five cents (0.45) is used to fund the super jackpot, and fifteen cents (0.15) is dedicated to administrative costs and profit.

The progressive jackpot game and method of the present invention is not limited to being played with five card poker games, but may be applied or used with other appropriate wagering games such as other poker games or games of chance. The method of the present invention does not require a shuffling machine 32, dealing module 33 or a display means 36. However, when the progressive jackpot game is played with a card game, these features facilitate and expedite the play of the game as well as add efficiency and interest. The bet for participation in the progressive jackpot game of the present invention may be in an amount other than one dollar, and the funding schedule set forth above may be varied. The accumulation period may also be varied, as long as a progressive jackpot sufficient to interest players accumulates. For example, the accumulation period may be a selected time period, may be based on the accumulation of a particular jackpot amount, or may be based on the accumulation of a certain number of finalists.

The progressive jackpot wagering game of the present invention, including the "Let It Ride" poker game aspects thereof, might be played live with a dealer at one or more gaming tables in one or more casinos, or in casinos, homes and other locations in interactive electronic or video form with automatic coin or betting means symbols, receptacles and payout capability, wherein appropriate symbols for cards, wagers or score keeping would be displayed electronically.

The present invention may be embodied in other specific forms without departing from the essential attributes thereof. It is desired that the embodiments described above be considered in all respects as illustrative, not restrictive, reference being made to the appended claims to indicate the scope of the invention.

What is claimed is:

1. A progressive jackpot wagering game for a number of players comprising:

each player placing a first wager to participate in a wagering game and a second wager to participate in said progressive jackpot game;

dealing cards to each player and dealing at least one common card;

giving each player the chance to withdraw at least part of said first wager based on said player's cards;

providing a hand for each player, each player's hand comprising said at least one common card and the cards each player was dealt; and resolving each player's first wager based on said hand, wherein if a player's hand comprises a predetermined arrangement of cards, that player wins a preselected amount, and resolving each player's second wager based on said hand, wherein if a player's hand comprises a predetermined arrangement of cards, that player wins an immediate bonus jackpot payout, and further wherein if a player's hand comprises a preselected one of said predetermined arrangements of cards, that player becomes eligible for a super jackpot payout.

2. The game according to claim 1, said first wager comprising a game participation wager and said second wager comprising an optional jackpot participation wager.

3. The game according to claim 2, wherein said game participation wager is divided into equal parts and wherein the number of said parts of said game participation wager that may be withdrawn is equal to the number of said at least one common card.

4. The game according to claim 1, wherein the progressive jackpot is progressive because any lost jackpot participation wager remains in said progressive jackpot for a predetermined accumulation period.

5. The game according to claim 4, wherein said accumulation period is at least one month.

6. A wagering game for a number of players, said game including a progressive jackpot game and comprising:

each player placing a wager including a three part game wager to participate in the game, said three parts being equal, and an optional jackpot wager to participate in said progressive jackpot game;

dealing three cards to each player and two common cards, all said cards being dealt face down;

giving each player the chance to withdraw part of said game wager based on that player's three cards;

showing one of said common cards;

giving each player another chance to withdraw part of said game wager based on that player's three cards and said showing common card;

showing the second of said two common cards, thereby providing a five card hand for each player, each player's five card hand comprising the two showing common cards and the three cards each player was dealt; and resolving each player's remaining game wager based on said five card hand, and, for those players who elected to place said optional jackpot wager, resolving said jackpot wager, wherein if a player's hand comprises a predetermined arrangement of cards, that player wins an immediate bonus jackpot payout, and further wherein if a player's hand comprises a preselected one of said predetermined arrangements of cards, that player becomes eligible for a super jackpot payout.

7. The game according to claim 6, wherein the progressive jackpot game is progressive because any lost jackpot wager remains in a progressive jackpot for a predetermined accumulation period.

8. The game according to claim 7, wherein said accumulation period is at least one month.

9. The game according to claim 8, wherein said accumulation period is three months.

10. The game according to claim 7, wherein said accumulation period is determined by accumulating a predetermined progressive jackpot amount.

11. The game according to claim 7 wherein said accumulation period is determined by accumulating a predetermined number of eligible players.

* * * * *

UNITED STATES PATENT AND TRADEMARK OFFICE

CERTIFICATE OF CORRECTION

PATENT NO. : 5,417,430

DATED : May 23, 1995

INVENTOR(S) : John G. Breeding

It is certified that error appears in the above-indentified patent and that said Letters Patent is hereby corrected as shown below:

On the title page, in the Notice of disclaimer,

—The term of this patent shall not extend beyond the expiration date of Patent No. 5,288,081—.

Signed and Sealed this

Fifth Day of December, 1995

*Attest:*

*Attesting Officer*

BRUCE LEHMAN

*Commissioner of Patents and Trademarks*